US007048046B1

(12) United States Patent
Sakamoto

(10) Patent No.: US 7,048,046 B1
(45) Date of Patent: May 23, 2006

(54) HIGH TEMPERATURE MECHANICAL SEAL

(75) Inventor: Stephen M. Sakamoto, Oklahoma City, OK (US)

(73) Assignee: Wood Group ESP, Inc., Oklahoma City, OK (US)

( * ) Notice: Subject to any disclaimer, the term of this patent is extended or adjusted under 35 U.S.C. 154(b) by 201 days.

(21) Appl. No.: 10/713,588

(22) Filed: Nov. 12, 2003

Related U.S. Application Data

(60) Provisional application No. 60/466,445, filed on Apr. 30, 2003.

(51) Int. Cl.
*E21B 43/12* (2006.01)

(52) U.S. Cl. ..... 166/105; 166/105.6; 166/112

(58) Field of Classification Search ..... 166/68, 166/105, 68.5; 277/361, 370, 366, 372; 417/201, 417/423.11, 414, 423.3

See application file for complete search history.

(56) References Cited

U.S. PATENT DOCUMENTS 4,232,770 A * 11/1980 Tuzson ..... 192/41 R
5,160,240 A * 11/1992 Wilson ..... 415/170.1
5,367,214 A * 11/1994 Turner, Jr. ..... 310/87
6,568,686 B1 * 5/2003 Hadley ..... 277/370
6,641,140 B1 * 11/2003 Matsumoto et al. ..... 277/366

* cited by examiner

*Primary Examiner*—Frank Tsay
(74) *Attorney, Agent, or Firm*—Crowe & Dunlevy, P.C.

(57) ABSTRACT

Preferred embodiments of the present invention provide a submersible pumping system for pumping wellbore fluids. The submersible pumping system includes a rotatable shaft and a mechanical seal that substantially surrounds the shaft. The mechanical seal prevents the flow of wellbore fluid along the shaft and includes a spring, a spring retainer and a runner. The spring surrounds the shaft and provides an axial force along the shaft. The spring retainer is affixed to the shaft and includes a detent to hold the spring. The runner is in interlocking engagement with the spring retainer and accommodates the spring. The interlocking engagement causes the runner to rotate within the spring retainer while permitting axial movement of the shaft relative to the runner.

12 Claims, 3 Drawing Sheets

HIGH TEMPERATURE MECHANICAL SEAL

RELATED APPLICATIONS

This application claims priority to U.S. Provisional Patent Application No. 60/466,445, entitled High Temperature Mechanical Seal filed Apr. 30, 2003, which is herein incorporated by reference.

FIELD OF THE INVENTION

This invention relates generally to the field of submersible pumping systems, and more particularly, but not by way of limitation, to a mechanical seal for use with a submersible pumping system.

BACKGROUND

Submersible pumping systems are often deployed into wells to recover petroleum fluids from subterranean reservoirs. Typically, the submersible pumping system includes a number of components, including one or more fluid filled electric motors coupled to one or more high performance pumps. Other components commonly used include seal sections and gearboxes. Each of the components and subcomponents in a submersible pumping system must be engineered to withstand the inhospitable downhole environment, which includes wide ranges of temperature, pressure and corrosive well fluids.

Keeping internal areas of the components free of the corrosive well fluids is both important and difficult in the downhole environment. Rotating shafts are commonly used in submersible pumping systems to transfer rotational energy from the motor to the pump assembly. Unfortunately, shafts provide a leak path for the corrosive well fluids to migrate into the components. It is difficult for a seal to effectively block the leak paths along a rotating shaft due to the rotation of the shaft.

Mechanical seals are used to keep well fluids from migrating along rotating shafts. Prior art designs typically include elastomer bellows, springs, runners and o-rings that cooperate to impede the migration of well fluids along the shaft. However, limitations in the present designs result in failures in the mechanical seal that allow well fluids to penetrate undesirable locations and to require costly repairs.

Mechanical seals that include an elastomer bellows have design limitations for applications that undergo axial movement of the shaft. This movement of the shaft can occur during pump starting conditions as a result of pump thrust. The axial movement can cause components of the mechanical seal to move relative to each other, thereby allowing fluid to leak past the seal.

Elastomer bellows in mechanical seals also are disadvantageous for varying depths and conditions of wells. Unique elastomer compounds are frequently needed for different characteristics encountered in a well, such as varying temperatures and corrosive chemical presence. Molding new bellows from alternative elastomers is time consuming and requires expensive tools.

Some mechanical seal designs do not use bellows along the rotating shaft, and instead use o-rings along the shaft. These designs typically use a spring to directly compress the o-ring against a runner and the shaft, thereby sealing the shaft and providing friction to hold the runner adjacent the shaft. Although this design permits axial movement of the shaft without losing the sealing capability of the mechanical seal, any damage to the o-ring may permit the runner to rotate on the shaft and cause the o-ring to fail. While this arrangement eliminates the problems associated with the bellows, it is not as robust as mechanical seals with bellows.

There is therefore a continued need for a mechanical seal for use with a pumping system that prevents leaks along the rotating shaft, eliminates problems associated with the bellows, allows axial movement of the shaft without seal failure, and prevents rotation of the runner relative to the shaft. It is to these and other deficiencies and requirements in the prior art that the present invention is directed.

SUMMARY OF THE INVENTION

Preferred embodiments of the present invention provide a submersible pumping system for pumping wellbore fluids. The submersible pumping system includes a rotatable shaft and a mechanical seal that substantially surrounds the shaft. The mechanical seal prevents the flow of wellbore fluid along the shaft and includes a spring, a spring retainer and a runner. The spring surrounds the shaft and provides an axial force along the shaft. The spring retainer is affixed to the shaft and includes a detent to hold the spring. The runner is in interlocking engagement with the spring retainer and accommodates the spring. The interlocking engagement causes the runner to rotate within the spring retainer while permitting axial movement of the shaft relative to the runner.

DETAILED DESCRIPTION OF THE PREFERRED EMBODIMENT

Figure 1:
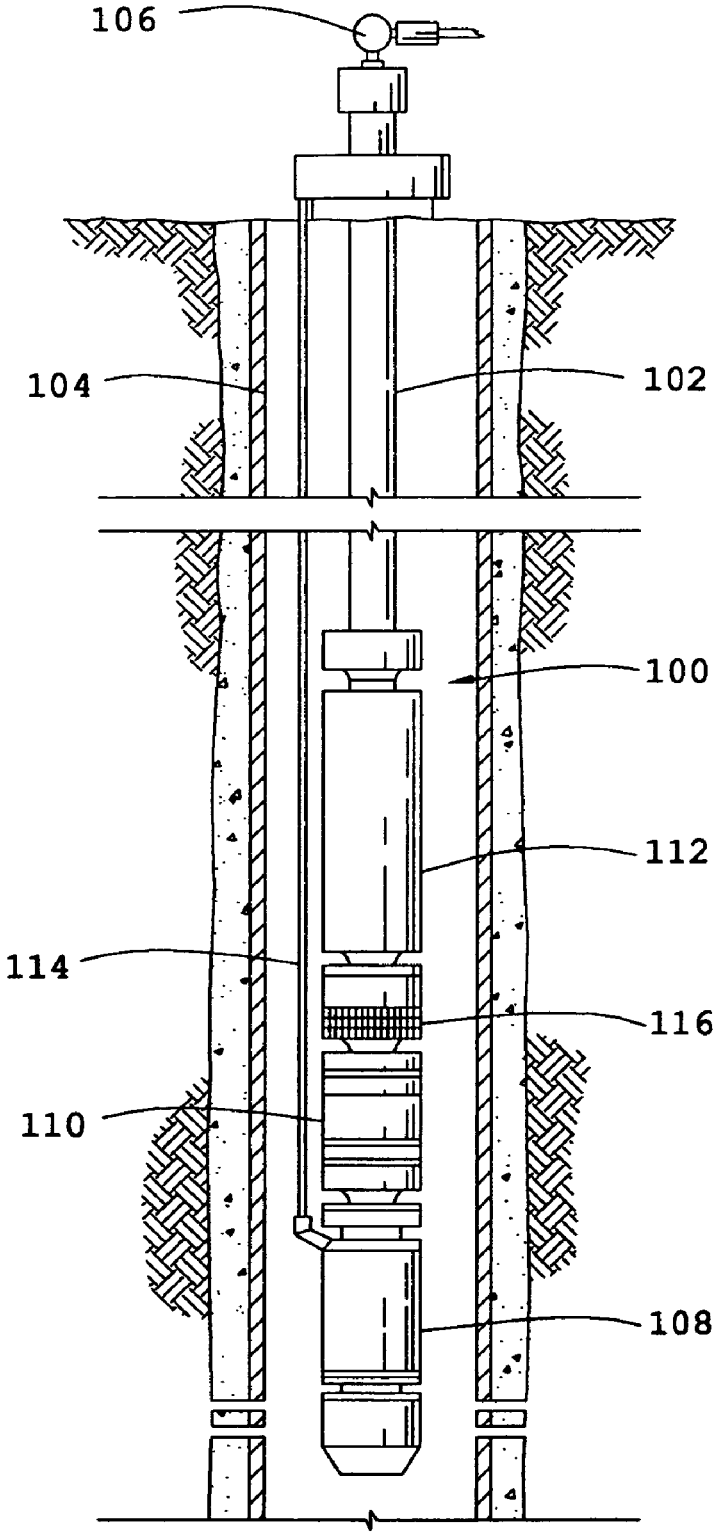
FIG. 1 is an elevational view of a submersible pumping system disposed in a wellbore.

In accordance with a preferred embodiment of the present invention, FIG. 1 shows an elevational view of a pumping system 100 attached to production tubing 102. The pumping system 100 and production tubing 102 are disposed in a wellbore 104, which is drilled for the production of a fluid such as water or petroleum. As used herein, the term "petroleum" refers broadly to all mineral hydrocarbons, such as crude oil, gas and combinations of oil and gas. The production tubing 102 connects the pumping system 100 to a wellhead 106 located on the surface.

The pumping system 100 preferably includes a motor assembly 108, a seal section 110, and a pump assembly 112. The seal section 110 shields the motor assembly 108 from axial thrust loading produced by the pump assembly 112 and from ingress of fluids produced by the well. Also, the seal section 110 allows motor lubricant to expand and contract without damaging the motor.

The motor assembly 108 is provided with power from the surface by a power cable 114. The motor assembly 108 converts electrical power into mechanical power to drive the pump assembly 112. Although only one pump assembly 112 and only one motor assembly 108 are shown, it will be understood that more than one of each can be connected to accommodate specific applications. The pump assembly 112 is preferably fitted with a pump intake 116 to allow well fluids from the wellbore 104 to enter the pump assembly 112. The pump intake 116 has holes to allow the well fluid to enter the pump assembly 112, and the well fluid is forced to the surface with the pump assembly 112 through production tubing 102.

Figure 2:
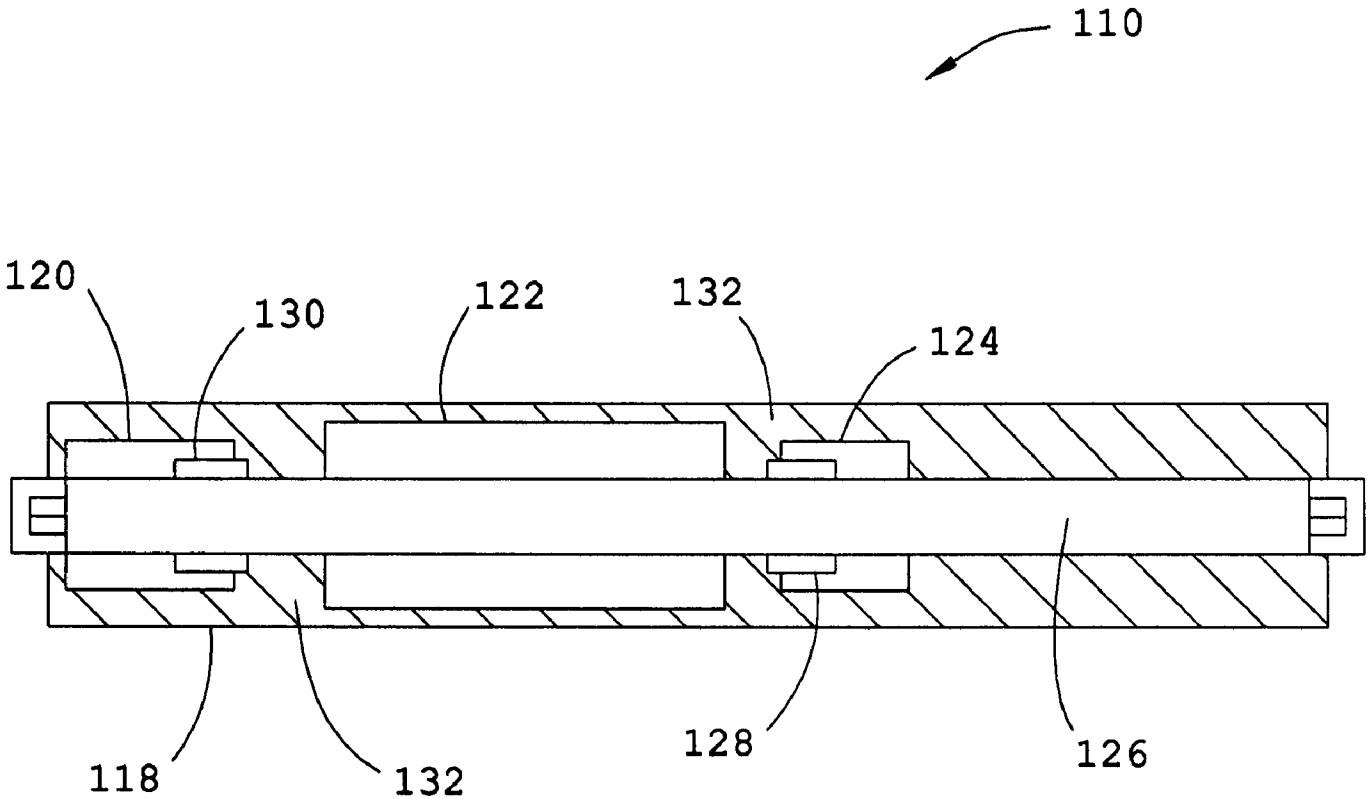
FIG. 2 is a cross sectional view of a seal section for use with the submersible pumping system of FIG. 1.

Referring now to FIG. 2, shown therein is a cross sectional view of the seal section 110 first shown in FIG. 1. The seal section 110 includes a housing 118 that forms chambers 120, 122 and 124. Also included in the seal section 110 is a rotatable shaft 126 and mechanical seals 128 and 130.

The shaft 126 is preferably connected to similar shafts (not shown) in the motor 108 and the pump 112. Rotation of the shaft 126 is achieved by rotation of the motor 108, and the shaft 126 in turn drives the pump 112. Mechanical seals 128, 130 prevent migration of wellbore fluid from the pump 112 along the shaft 126.

Figure 3:
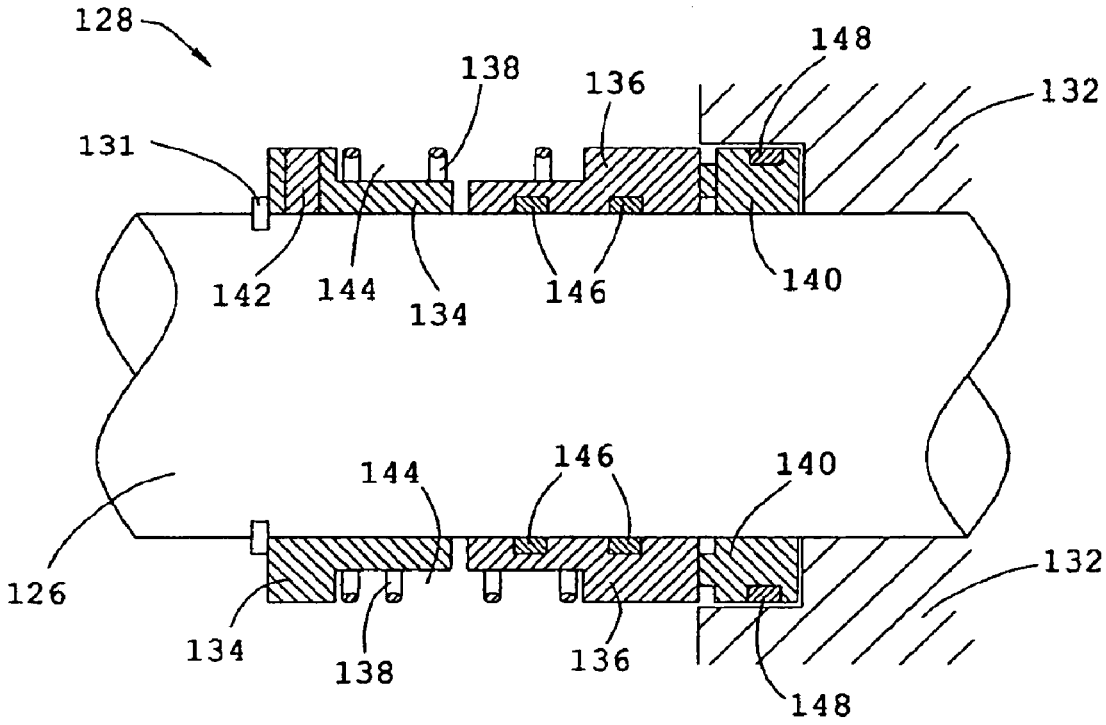
FIG. 3 is a cross sectional view of a mechanical seal for use with the pump assembly of FIG. 1.

Shown in FIG. 3 is a cross-sectional view of the mechanical seal 128 constructed in accordance with a preferred embodiment of the present invention. The mechanical seal 128 is shown with shaft 126, a snap ring 131 and a seal section housing 132, and includes a retaining ring 134, a runner 136, a spring 138 and a mating ring 140.

The retaining ring 134 is preferably constructed of a corrosion resistant metal, such as stainless steel, although it is contemplated that many metals and alloys are suitable for construction of the retaining ring 134. Similarly, the runner 136 and the mating ring 140 are preferably constructed of a durable material, such as tungsten, silicon carbide or suitable ceramic. These materials are preferred due to their resistance to the abrasion caused by sand or other particulate matter frequently present in wellbore fluid that can wear components of the mechanical seal 128, although other resistant materials are also suitable.

The retaining ring 134 preferably includes a set screw 142 and a detent 144. The retaining ring 134 is affixed to the shaft 126 using the set screw 142, although other methods of affixing the retaining ring 134 securely to the shaft 126 are suitable. The detent 144 holds the spring 138 in place by providing a depression in which the spring 138 can reside. The detent 144 provides a surface to oppose the axial force provided by the spring 138.

The runner 136 preferably accommodates the spring 138 and can include one or more o-rings 146. The spring 138 is accommodated by the runner 136 such that the spring 138 exerts an axial force on the runner 136 in a direction away from the retaining ring 134. The o-rings 146 are preferably constructed of an elastomer material and provide a seal between the shaft 126 and the runner 136.

The mating ring 140 abuts the runner 136 and the seal section housing 132. An o-ring 148 is preferably included with the mating ring 140 and provides a seal between the mating ring 140 and the seal section housing 132. The mating ring 140 is preferably separated from the runner 136 by a thin layer of fluid that is present in the seal section 110. This fluid may be wellbore fluid that has penetrated the seal section 110 or lubricant that resides in the seal section 110.

Figure 4:
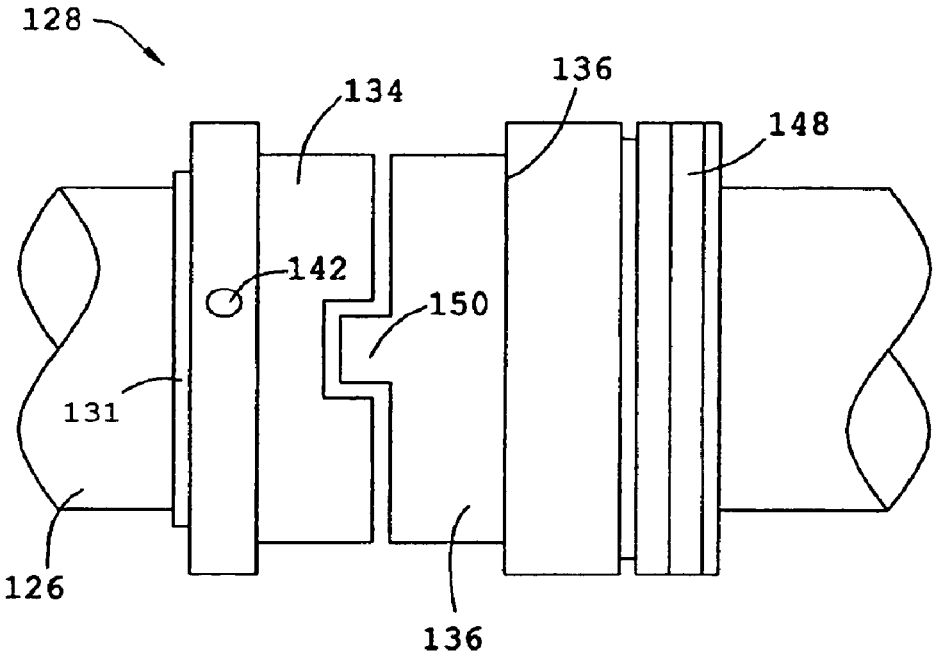
FIG. 4 is a side view of the mechanical seal of FIG. 3.

Referring now to FIG. 4, shown therein is a side view of the mechanical seal 128 depicted in FIG. 3, with the spring 138 omitted to accurately demonstrate a preferred embodiment of the present invention. The retaining ring 134 and the runner 136 are shown in interlocking engagement. The runner 136 preferably includes a tab 150 that extends into the retaining ring 134. However, the interlocking engagement can also be achieved by other arrangements, such as multiple tabs or other configurations that interlock the retaining ring 134 and the runner 136. Similarly, a tab can extend from the retaining ring 134 into the runner 136 to provide the interlocking engagement.

The retaining ring 134 is affixed to the shaft 126 by tightening the set screw 142. Other methods may also be used to affix the retaining ring 134 to the shaft 126, such as pins, keys or other known methods employed in the art. Also, the snap ring 131 further prevents the axial movement of the mechanical seal 128.

The runner 136 is urged away from the axially fixed retaining ring 134 and toward the mating ring 140 due to the axial force imparted by the spring 138. During axial movement of the shaft 126, the spring 138 holds the runner 136 in position against the mating ring 140. The unique interlocking engagement of the spring retainer 134 and the runner 136 causes the runner 136 to rotate while compensating for axial movement of the shaft 126. For example, if the shaft 126 is axially displaced, the spring 128 maintains the position of the runner 136 adjacent the mating ring 140. The runner 136 continues to rotate while being held in a position adjacent the mating ring 140 by the spring 128. The o-rings 146 help seal any space between the runner 136 and the shaft 126, and o-rings can be added or subtracted based on the application and environment in which the mechanical seal 128 is used.

The mating ring 140 preferably does not turn relative the shaft 126, and a seal is maintained between the seal section housing 132 and the mating ring 140 by the o-ring 148. The outer diameter of the o-ring 148 is preferably large enough to prevent rotation of the mating ring 140 with the shaft 126. The relative rotation between the mating ring 140 and the runner 136 is preferably assisted by the thin layer of lubricant or well fluid, yet contact between the mating ring 140 and the runner 136 impedes fluid flow.

Although the present invention has been demonstrated for use within a seal section 110, it should be understood that application of the invention can be within any component that employs a rotating shaft wherein the prevention of fluid flow is desired. Among the possible applications include but are not limited to motors, pumps and gearboxes.

In accordance with one aspect of a preferred embodiment, the present invention provides an apparatus for preventing the flow of wellbore fluids along the shaft 126 of the pumping system 100, thereby protecting interior portions of the pumping system 100. It is to be understood that even though numerous characteristics and advantages of various embodiments of the present invention have been set forth in the foregoing description, together with details of the structure and functions of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. It will be appreciated by those skilled in the art that the teachings of the present invention can be applied to other systems without departing from the scope and spirit of the present invention.

What is claimed is:

1. A submersible pumping system for pumping wellbore fluid, comprising:

a rotatable shaft;

a housing; and a mechanical seal substantially surrounding the shaft for preventing the flow of wellbore fluid along the shaft, the mechanical seal comprising:

a spring surrounding the shaft and providing an axial force along the shaft;

a spring retainer affixed to the shaft and having a detent to hold the spring;

a runner in interlocking engagement with the spring retainer and accommodating the spring, wherein the interlocking engagement causes the runner to rotate with the spring retainer while permitting axial movement of the shaft relative to the runner; and a mating ring that substantially encircles the shaft and contacts the runner, wherein the mating ring includes an o-ring that abuts the housing.

2. The submersible pumping system of claim 1, wherein the runner further comprises an o-ring that abuts the shaft.

3. The submersible pumping system of claim 1, wherein the spring retainer is affixed to the shaft with a set screw.

4. The submersible pumping system of claim 1, further comprising a snap ring adjacent the spring retainer and fixed to the shaft wherein axial movement of the mechanical seal is prevented.

5. A seal section for use with submersible pumping system for pumping wellbore fluid, comprising:

a rotatable shaft;

a housing; and a mechanical seal substantially surrounding the shaft for preventing the flow of wellbore fluid along the shaft, the mechanical seal comprising;

a spring surrounding the shaft and providing an axial force along the shaft;

a spring retainer affixed to the shaft and having a detent to hold the spring;

a runner in interlocking engagement with the spring retainer and accommodating the spring wherein the interlocking engagement causes the runner to rotate with the spring retainer while permitting axial movement of the shaft relative to the runner; and a mating ring that substantially encircles the shaft and contacts the runner, wherein the mating ring includes an o-ring that abuts the housing.

6. The seal section of claim 5, wherein the runner further comprises an o-ring that abuts the shaft.

7. The seal section of claim 5, wherein the spring retainer is affixed to the shaft with a set screw.

8. The seal section of claim 5, further comprising a snap ring adjacent the spring retainer and fixed to the shaft wherein axial movement of the mechanical seal is prevented.

9. A mechanical seal for use with a rotatable shaft for preventing the flow of fluids along the shaft, the mechanical seal comprising:

a spring surrounding the shaft and providing an axial force along the shaft;

a spring retainer affixed to the shaft and having a detent to hold the spring; and a runner in interlocking engagement with the spring retainer and accommodating the spring wherein the interlocking engagement causes the runner to rotate with the spring retainer while permitting axial movement of the shaft relative to the runner; and a mating ring that substantially encircles the shaft and contacts the runner, wherein the mating ring includes an o-ring at the outside diameter of the mating ring.

10. The mechanical seal of claim 9, wherein the runner further comprises an o-ring that abuts the shaft.

11. The mechanical seal of claim 9, wherein the spring retainer is affixed to the shaft with a set screw.

12. The mechanical seal of claim 9, further comprising a snap ring adjacent the spring retainer and fixed to the shaft wherein axial movement of the mechanical seal is prevented.

* * * * *